US006145132A

United States Patent [19]

Towner

[11] Patent Number: 6,145,132

[45] Date of Patent: Nov. 14, 2000

[54] TWO-PLY BOXER SHORTS

[76] Inventor: Mark Towner, 840 26 1/2 Rd., Grand Junction, Colo. 81506

[21] Appl. No.: 09/351,225

[22] Filed: Jul. 12, 1999

[51] Int. Cl.[7] ..... A41B 9/00

[52] U.S. Cl. ..... 2/400

[58] Field of Search ..... 2/400, 228, 238, 2/213, 403, 404, 408

[56] References Cited

U.S. PATENT DOCUMENTS

| | | | |
|---|---|---|---|
| Re. 26,682 | 10/1969 | Terry | 2/404 |
| 2,034,312 | 3/1936 | Rubin | 2/228 |
| 2,599,769 | 6/1952 | MacRae et al. | 2/404 |
| 2,983,924 | 5/1961 | Cohen et al. | 2/238 |
| 4,223,408 | 9/1980 | Sullivan | 2/238 |
| 4,961,233 | 10/1990 | Black | 2/228 |
| 5,052,058 | 10/1991 | Mueller | 2/228 |
| 5,649,328 | 7/1997 | Martin | 2/238 |

OTHER PUBLICATIONS

Eastbay Catalog, 1999, p. 33, Reversible Eastbay mesh shorts.

*Primary Examiner*—John J. Calvert
*Assistant Examiner*—Alissa L. Hoey
*Attorney, Agent, or Firm*—Richard W. Hanes

[57] ABSTRACT

A two-ply undergarment having an outer layer of pliant material with slick inner and outer surfaces and including front, rear and lateral aspects, defining a pair of shorts with a circular waistband, a midriff enclosing portion depending from the waistband and a pair of depending leg encircling portions with lower edge perimeters, an inner layer of pliant material substantially congruent with the outer casing and having slick inner and outer surfaces where the outer casing and the inner layer are attached together at least along the waistband and around the leg perimeters.

4 Claims, 4 Drawing Sheets

TWO-PLY BOXER SHORTS

The present invention relates generally to under garments and more specifically to the type thereof known as boxer shorts.

BACKGROUND

Below-the-waist undergarments for either male or female usually take the form of close fitting briefs or loose fitting shorts having abbreviated legs, the later often being referred to as "boxer shorts." While significant possible comfort associated with the looseness of boxer shorts may be acclaimed by many, that aspect of the product is frequently offset by the tendency of the shorts to ride up on the leg of the wearer, bunching the fabric, and making for discomfort and unsightly bulges and wrinkles under outer clothing. The riding up and subsequent bunching of the material of the shorts occurs because of the friction between the material of the shorts and the outer garment.

As far back as 1922 there was at least one documented attempt to solve the problem of the bunching of undergarment material. The resulting product was the subject of U.S. Pat. No. 1,419,940 to M. N. Mills. While one of the objects of the inventive undergarment disclosed in that patent was to prevent bunching, nothing was really said in the description of the invention that would explain how that objective was achieved. The patent describes a petticoat hanging from a common waistband with underlying drawer or bloomer legs.

U.S. Pat. No. 5,598,586 to Deon C. Munjone describes athletic shorts with inner and outer layers, but the inner layer appears to be much like the drawer legs of the aforesaid Mills patent, that is, structurally independent of the outer shell of the garment. Munjone shows no recognition of the riding-up problem as one to be solved by inner and outer layers of material. Nor should he, because the pair of athletic shorts disclosed in the Munjone patent is intended as an outer garment.

The lower body garment of the Popa et al., disclosed in U.S. Pat. No. 5,613,378, is one having a lining and an outer shell, the two being integrally knit at the waistband and joined by a continuous longitudinal leg enclosing seam. The patent specification suggests that capturing both the lining and the shell by the longitudinal seam will keep the lining in place, suggesting that the lining would ride or bunch up, similar to the material of the boxer shorts, if not held in place. The lining of the Popa et al. lower body garment is analogous to the material of ordinary single-ply boxer shorts. But, in order to prevent bunching or ride-up, it is not practical to actually attach the boxer shorts to the outer garment, as Popa et al. have done with the lining of their patented garment.

Garment linings for coats, trousers and skirts, either full or partial, are old in the art. However, as seen by the foregoing relevant patents, the concept of utilizing a full lining for an under garment, such as boxer shorts, has not been implemented to provide this popular type of apparel with features of maximum comfort and enrichment of outer garment appearance.

Accordingly, the primary object of the present invention is to provide a loose fitting undergarment that will not be subject to bunching or riding up on the leg of the wearer.

Other and further objects, features and advantages of the invention will become apparent upon a reading of the following description of the invention, taken in conjunction with the accompanying drawings.

DRAWINGS

SUMMARY OF THE INVENTION

Figure 1:
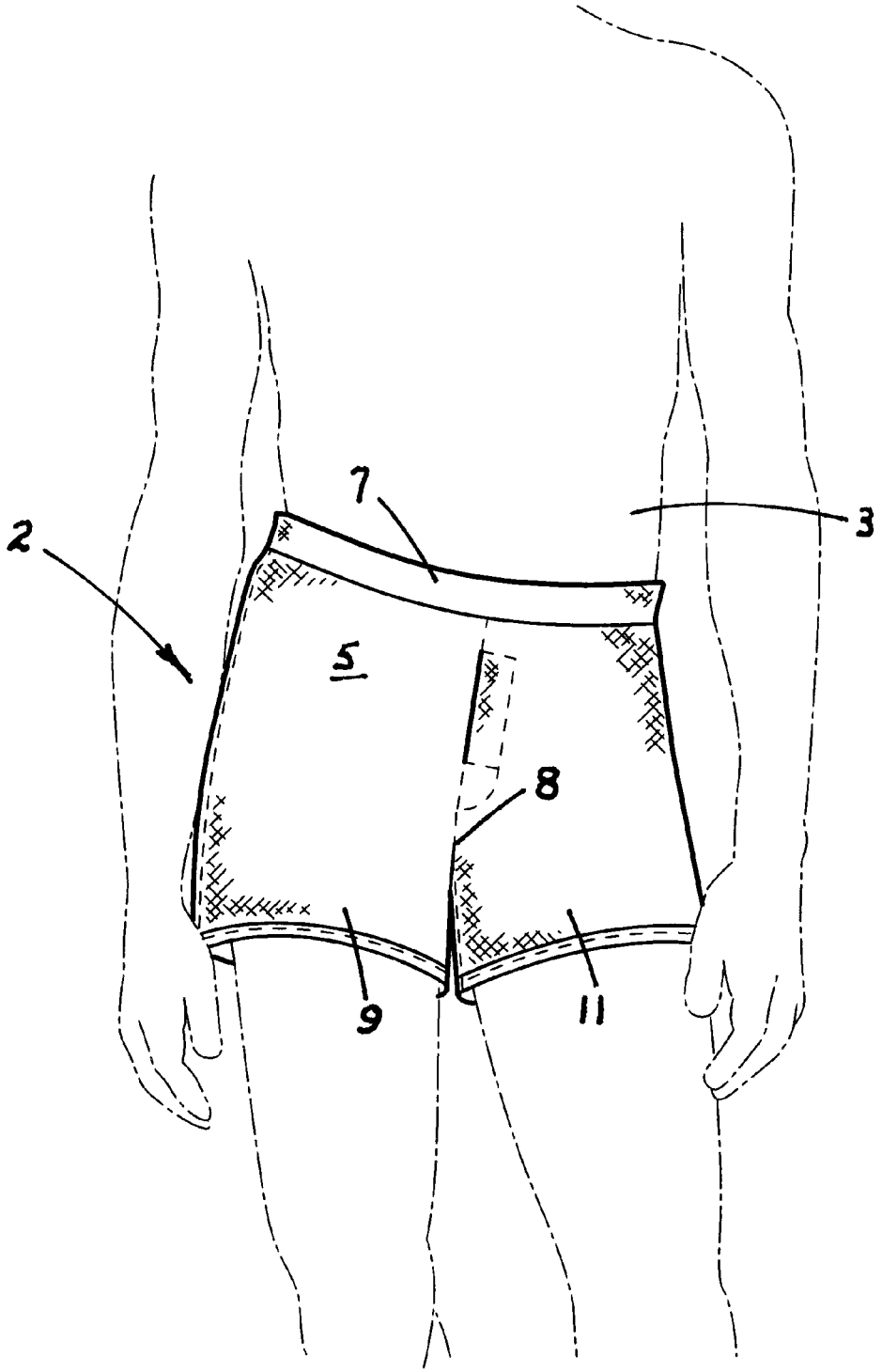
FIG. 1 is a perspective view of the boxer shorts of the present invention.
Figure 2:
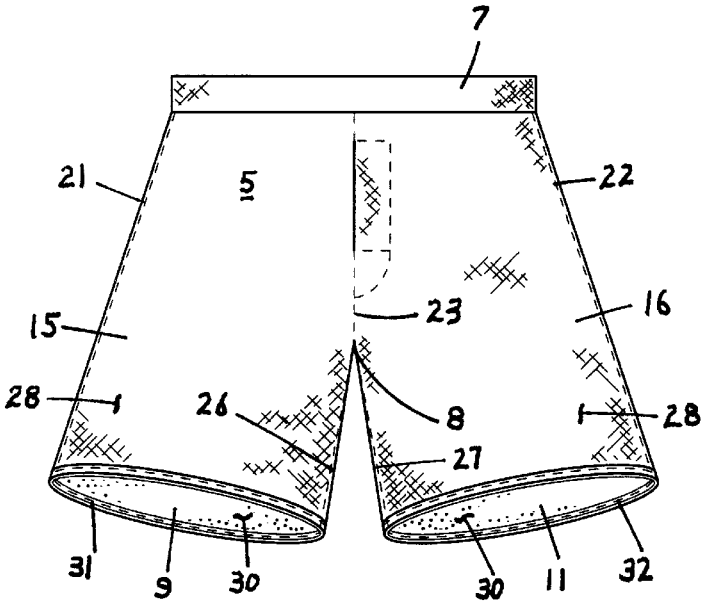
FIG. 2 is a front view of the boxer shorts of the present invention showing in dotted lines the seam interconnection between the inner layer of nylon tricot and the outer shell of nylon micro mesh.
Figure 3:
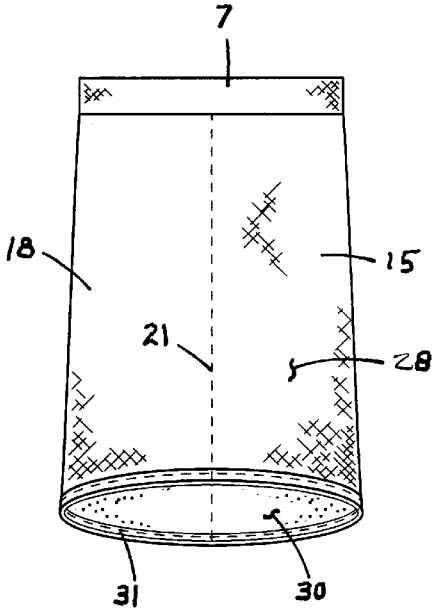
FIG. 3 is a side view showing the seam connection similar to that of FIG. 2.
Figure 4:
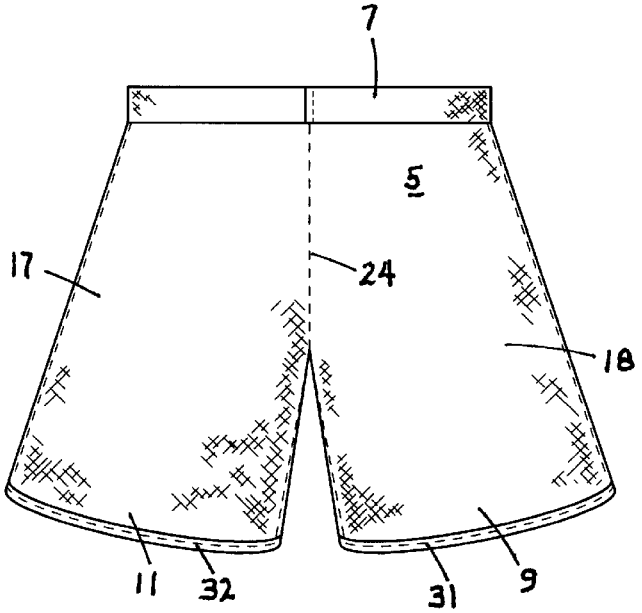
FIG. 4 is a rear view of the shorts showing the seam connection similar to that of FIG. 2.

The boxer type shorts under garment of the present invention comprise a pliant outer casing made of material such as nylon, that has slick inner and outer surfaces, and includes front, rear and lateral aspects. A circular waistband tops a midriff enclosing portion from which depends a pair of abbreviated legs. An inner layer of pliant material that is substantially congruent with the outer casing is sewn to the outer casing, forming a double layered garment. The material of the inner layer also has slick surfaces, preferably of greater slickness than that of the surfaces of the casing material. The low coefficient of friction between the outer casing and the inner layer of material prevents the legs of the shorts from riding up on the wearer's legs and bunching the material.

DETAILED DESCRIPTION

The undergarment 2 of the present invention is shown generally, as it would appear on the body 3 of a wearer. The boxer shorts of this invention include a midriff encircling portion 5 that is bounded along its top margin with an attached elastic waistband 7. At the crotch 8, the midriff portion 5 divides into two abbreviated legs 9 and 11. An opening 13 in the front of the shorts and above the legs provides a functional fly. The midriff and legs are formed by sewing together four different panels 15, 16 17 and 18. The panels are joined by sewing along lateral side seams 20 and 21, front and back seams 23 and 24 and in-seams 26 and 27.

Figure 5:
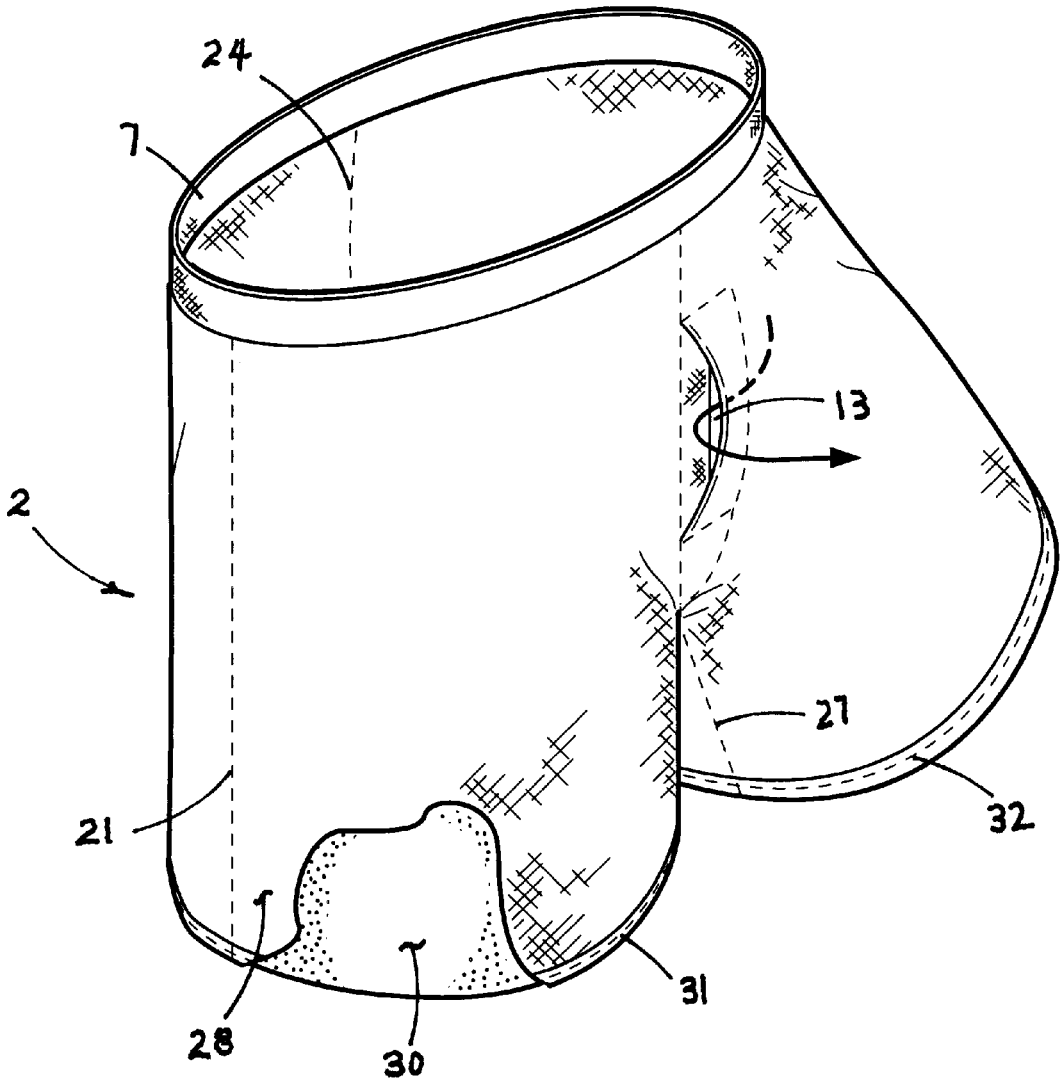
FIG. 5 is an enlarged perspective view of the shorts of the present invention with a part of the outside shell cut away to reveal the inner layer of nylon tricot.
Figure 6:
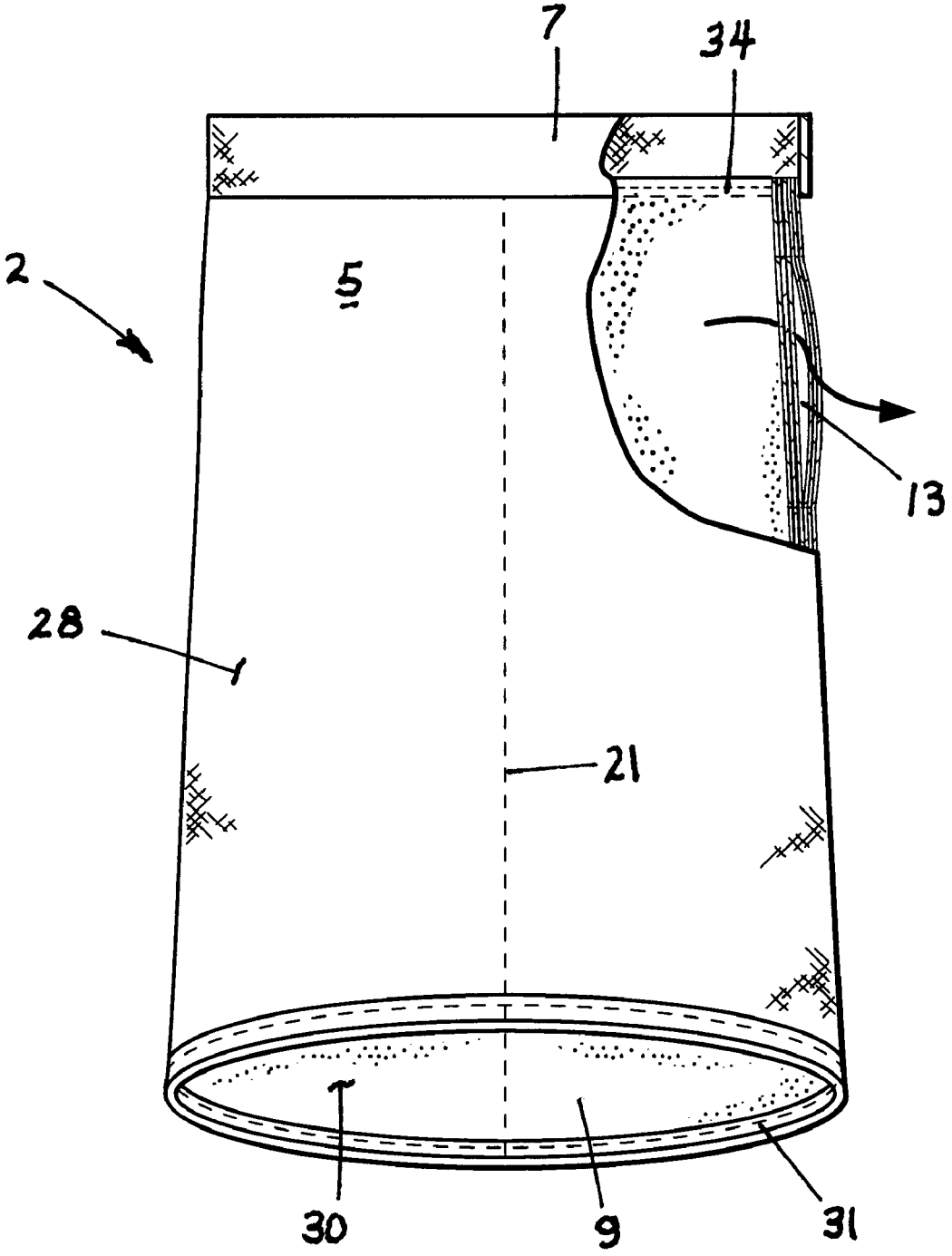
FIG. 6 is an enlarged side view of the shorts of the present invention with a portion thereof cut away to show the inner layer and outer shell in cross section across the functional fly.

Each of the four panels comprise an outer casing 28 and an inner lining 30 (See FIG. 5). Preferably, the outer casing 28 of the boxer shorts 2 is made of Nylon Micro Mesh material, while the inner lining 30 is Nylon tricot. The inner lining and the outer casing are joined and sewn together along the seams 21, 22, 23, 24, 26 and 27, as well as around the cuff seams 31 and 32, along the bottom edge of each leg, and also along the seam 34 joining the waistband and the midriff portion.

By fabricating each of the panels 15, 16, 17 and 18 out of two layers of Nylon material, a two-ply undergarment is provided. Each of the Nylon layers of material presents a "slick" finished surface on both of its faces. Accordingly, as the inside surfaces, or facing surfaces, of the two Nylon layers are in contact with one another, the coefficient of friction between the two layers is very low. The inside surface of the outer casing 28 may move with relative ease against the facing surface of the inner lining 30.

The fact that the two facing slick surfaces of the outer casing and the inner lining may move easily with respect to one another accounts for the implementation of the primary object of the invention. In single ply boxer shorts the outside (outer garment facing side) surface of the fabric tends to adhere to the outer garment and as the trouser leg, for example, rises on the leg of the wearer, it tends to pull the boxer shorts material with it, causing bunching of the shorts material and the well known "riding-up" of the undergarment. When the upward trouser force on the shorts material is released or reversed in direction the shorts material does not follow and descend on the leg because of the high degree of friction between the skin-facing side of the shorts material and the skin of the wearer's leg. Bunching of the shorts material and riding-up is the result.

In the boxer shorts of the present invention, two alleviating factors are at work to prevent the riding-up and bunching of the fabric. First, the Nylon, or similarly slick material of the outer casing 28 has a lower coefficient of friction with the outer garment and is less likely to follow the movement of the outer garment than less slick materials. Secondly, and more important however, is the fact that the low amount of friction between the inner and outer layers of material in the shorts eliminates the riding-up of the two-ply shorts. To the extent that the outer layer 28 is pulled by its contact with the outer garment, it will move easily against the inner surface of the inner lining material 30. When the pulling force is released or reversed, the outer casing 28 can return to its normal position, without regard to skin contact, because its inside surface contact is solely with the inner surface of the inner layer of material which is a very low friction contact.

Similarly, if the inside lining layer 30, next to the skin of the wearer, is pulled upwardly by its friction with the skin, the inside layer will move easily against its low friction contact with the inside surface of the outer casing 28. As the pulling force of the skin is released or reversed, the skin facing inner liner 30 will not be restrained by friction on its other surface from returning to a normal position because of the low friction contact between the inner lining 30 and the outer casting 28.

In order to accomplish the objects of the invention it is necessary that the inner lining 30 and the outer casing 28 be interconnected, as they are by sewing along the seams the leg cuffs and the waistband, as heretofore explained. If the two layers of material were rot so interconnected, differential body or garment friction on the layers would tend to separate them and the remaining single layer would respond to garment and skin friction in much the same way as the material of the prior art single ply boxer shorts.

While the preferred materials of the two-ply shorts are Nylon Micro Mesh and Nylon tricot, as explained above, other suitable materials having similar properties of surface slickness can be used.

I claim:

1. An undergarment, comprising, a pliant outer casing having slick inner and outer surfaces and including front, rear and lateral aspects, defining a pair of shorts with a circular waistband, a midriff enclosing portion depending from the waistband and a pair of depending leg encircling portions with lower edge perimeters, an inner layer of pliant material substantially congruent with the outer casing and having slick inner and outer surfaces, means interconnecting the outer casing and the inner layer of pliant material at least along the waistband and around the leg perimeters.

2. The undergarment of claim 1 where the outer casing comprises nylon micro mesh.

3. The undergarment of claim 1 where the inner pliant material comprises nylon tricot.

4. The undergarment of claim 1 and further including, an opening in the front aspect of the garment defining a functional fly.

* * * * *